United States Patent [19]

Carpentier

[11] 3,986,700

[45] Oct. 19, 1976

[54] ACTUATOR FOR YARD HYDRANT

[75] Inventor: John H. Carpentier, Fort Atkinson, Wis.

[73] Assignee: Whitewater Mfg. Co., Whitewater, Wis.

[22] Filed: Feb. 13, 1975

[21] Appl. No.: 549,643

Related U.S. Application Data

[62] Division of Ser. No. 312,160, Dec. 4, 1972, Pat. No. 3,885,585.

[52] U.S. Cl. ..... 251/296; 251/100; 251/98; 251/235; 137/636.2

[51] Int. Cl.[2] ..... F16K 31/44

[58] Field of Search ..... 251/98, 100, 296, 235, 251/284, 285, 100; 222/509; 137/282, 292, 303, 305, 636.2, 636.3

[56] References Cited

UNITED STATES PATENTS

| | | | |
|---|---|---|---|
| 781,525 | 1/1905 | Isaacs | 137/636.2 |
| 2,945,703 | 7/1960 | Ballard | 251/100 |
| 3,384,121 | 5/1968 | Spencer | 251/284 |

FOREIGN PATENTS OR APPLICATIONS

| | | | |
|---|---|---|---|
| 142,631 | 7/1951 | Australia | 251/100 |
| 896,888 | 3/1945 | France | 251/100 |

*Primary Examiner*—William R. Cline
*Assistant Examiner*—H. Jay Spiegel
*Attorney, Agent, or Firm*—Wheeler, Morsell, House & Fuller

[57] ABSTRACT

A frost-free hydrant includes a reservoir below the frost line which is completely sealed from ground water and which is emptied by a venturi in the valve when the hydrant is used. An indicator raised by a float warns of undue accumulation of water in the reservoir and seals the air vent to the reservoir. An actuating handle for the valve is depressed to permit water to flow and may be swung laterally in either direction to hold any adjustment from trickle to full flow. Anti-siphoning openings are included in the valve actuating rod.

2 Claims, 6 Drawing Figures

14
17
12
20
21
13
15
16
18
22
11
49
24
19
23
25
10
31
33
32
27
26
28
37
3
3
29
36
38
35
34
30

33
40
39
4
4
40
34
35
25
19
26
61
5
5
54
60
59
57
58
55
53
56
52
50
51
41
25

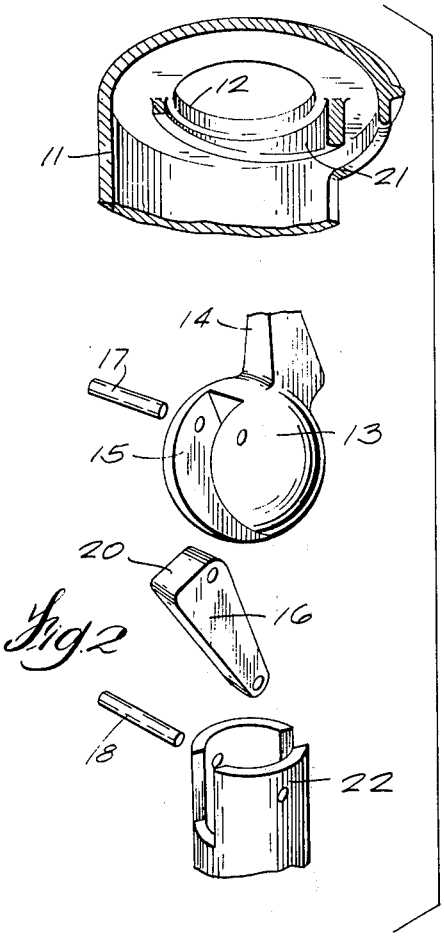
Fig. 2
Fig. 3
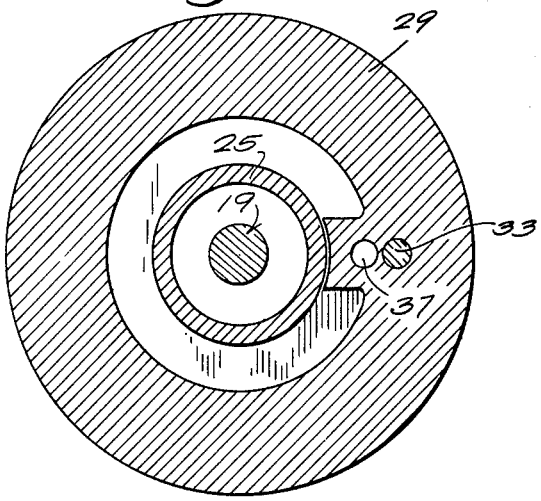
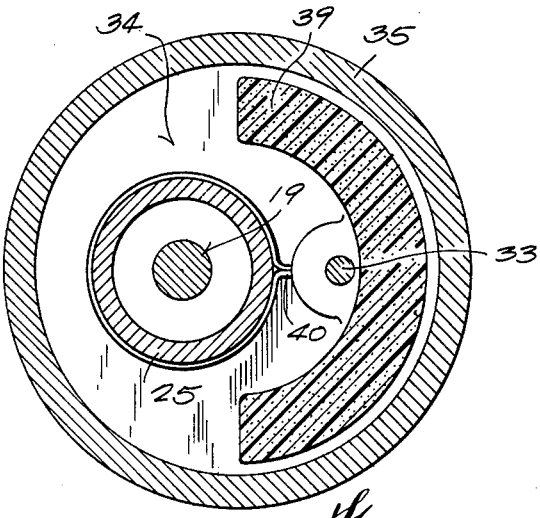
Fig. 4
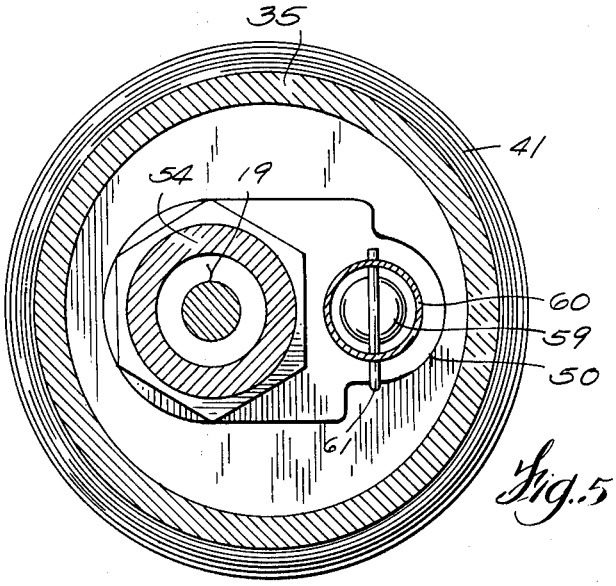
Fig. 5

ACTUATOR FOR YARD HYDRANT

This application is a division of application Ser. No. 312,160, filed Dec. 4, 1972 now Pat. No. 3,885,585.

BACKGROUND OF THE INVENTION

Existing frost-free yard hydrants drain water which is left standing above the buried valve in the hydrant into the ground. Such provisions require an opening from the water pipe to the ground below ground level. Any such opening, however it is protected and sealed, is vulnerable to the entrance of unsanitary ground water, which may thereafter be supplied with water from the hydrant.

SUMMARY OF THE INVENTION

The present hydrant solves the sanitation problem with a reservoir which is completely sealed from contact with ground water. The reservoir is filled through a check valve having a buoyant sealing ball and is emptied during use of the hydrant by entraining the stored water in the stream of newly supplied water by means of a venturi combined with the valve, until the buoyant ball seals the check valve. Because the stored water is completely sealed from ground water it is as wholesome as the newly supplied water and does not detract from the quality of the water supplied.

A venturi may be ineffective to remove the stored water during periods when the hydrant is turned on only slightly. Accordingly, a float within the reservoir lifts a visible signal into view of the operator when the level of the stored water becomes excessive. At the same time, the air vent at the top of the reservoir is sealed to prevent further accumulation of water above frost level. When the signal is displayed, the operator opens the hydrant fully for a time, thus draining the reservoir and averting any damage from freezing.

A novel provision against back siphoning is provided at the spout of the hydrant. The valve operating rod extends through the spout, and the upper portion of the rod is a tube having a side opening within the spout to admit air to the spout in sufficient quantity to prevent siphoning.

A novel operating handle for the valve rod comprises a universally mounted generally spherical base for the operating lever biased upwardly into engagement with a retaining means. As shown this is a circular opening in the housing. A link extends from a pivot secured to the spherical base at a point removed from the center of the sphere to pivot in a rotatable connection with the top of the valve operating rod, to depress the valve operating rod whenever the operating lever is depressed in any direction. The link is provided with a surface laterally beyond the surface of the sphere. A stop is provided against which the link surface can be urged by the biasing force to retain the rod in a desired position. As shown, the stop is a circular inclined cam concentric with the sphere and preferably having the form of a cylinder terminating along plane at an angle to the axis of the cylinder. The projecting surface, or shoulder, of the link may be engaged against the cam, or stop, to hold the valve operating rod against the bias of the rod in any position from fully raised to fully depressed without further attention by the operator, merely by depressing the operating handle until the correct flow of water is achieved and then rotating the handle until the shoulder of the link strikes the circular cam surface. Upon releasing the operating lever the flow of water will be maintained at the present level. To turn off the water the operating lever is returned to a position approximately in line with the spout and released. Because the shortest axial dimension of the cam is at that point, the release of the lever permits the valve to shut off under the bias of the water pressure (or an optional mechanical biasing means such as a spring) acting on the valve rod.

Whenever the hydrant is shut off the check valve permits the column of water within the hydrant to drain into the reservoir, especially since the valve element of the check valve is buoyant. Retainer means are provided to keep the sealing ball of the check valve above the valve seat.

The venturi which drains the storage reservoir includes a converging cone and a jet formed by the valve itself. The converging cone of the venturi is the valve seat. The valve rod carries a valve closure having a conical surface complementary to the converging cone of the venturi-valve-seat and extends through the center of the orifice, in effect forming the inner wall for a ring shaped jet projecting a high speed stream of water across a chamber open to the storage reservoir through the check valve. After crossing the chamber the jet enters a very short second converging section of the venturi which merges immediately into the diverging cone section, which is joined to ordinary piping leading to the hydrant spout.

The reservoir is provided with an air relief vent at the upper end so that water may freely enter and leave the reservoir. The reservoir is also provided with means to signal over-filling. As shown this is a float located near the frost line and fixed to a rod extending upwardly through a valve member adapted to close the air vent when raised, and terminating in a visible indicator that the water level in the reservoir is too high. The specific form shown is a sleeve fastened to the top of the float rod, the sleeve being painted in a warning color such as red and being so formed as to be visible through a window in the housing only when the float is lifted by an excessive water level. Thus when the indicator is visible the operator is warned to turn the hydrant on full to drain the reservoir to a safe level. The return of the indicator to concealed position indicates that the reservoir has in fact been sufficiently drained. The structure desired could, if desired, be modified to indicate on a scale the level of the water within the reservoir.

DRAWINGS

In FIGS. 1A and 1B portions of the height are omitted which do not contain additional detail and which are of optional length to suit the depth required for frost protection.

FIG. 2 is an exploded perspective view of the principal parts of the operating lever, with portions of the housing broken away to show detail.

FIG. 3 is a cross-sectional view on line 3—3 of FIG. 1A.

FIG. 4 is a cross-sectional view on line 4—4 of FIG. 1B.

FIG. 5 is a cross-sectional view on line 5—5 of FIG. 1B.

DETAILED DESCRIPTION

Although the following description is detailed in order to best set forth the illustrated embodiment of the invention, the details are intended by way of explanation rather than limitation, the invention being defined in the attached claims.

Figure 1A:
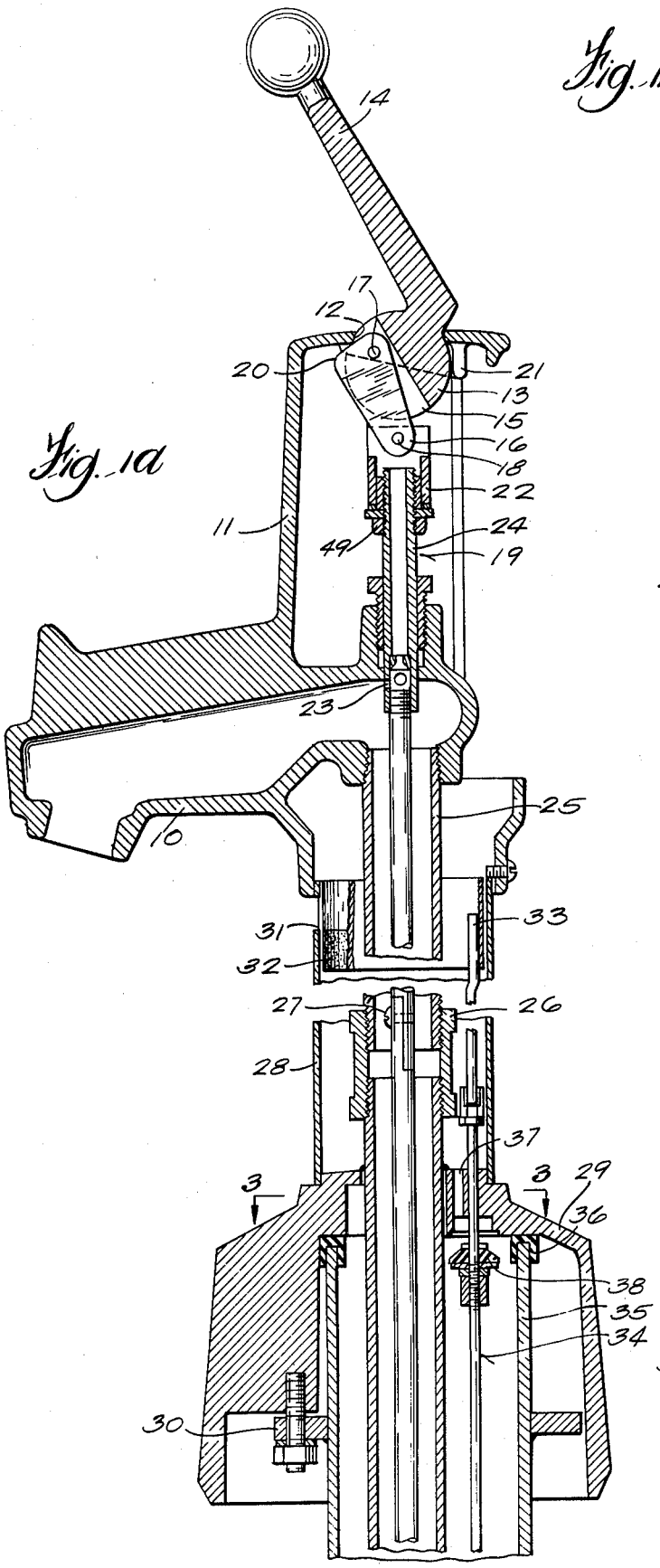
FIG. 1A is the top portion of a vertical, axial cross-sectional view through the hydrant of my invention.

As shown in FIG. 1A my yard hydrant has a spout 10 extending laterally and downwardly from an integral upper housing 11 provided with a circular opening 12. Opening 12 is smaller in diameter than a sphere 13 and forms a seat or universal mount for the sphere. Sphere 13 forms the base of an operating lever 14, the major portion of the sphere being within housing 11 and below opening 12. The sphere 13 is slotted at 15 to receive a link 16 extending from a pivot 17 within the slot 15, but spaced from the axis of sphere 13, to a pivot 18 on the axis of valve operating rod 19. Thus handle 14 may be depressed to move valve rod 19 downwardly through the action of link 16.

Link 16 has a surface or shoulder 20 extending laterally beyond the surface of sphere 13 and beyond opening 12. Opening 12 is surrounded by a circular stop or cam 21 having the form of a cylinder cut on a plane at an angle to its axis, the diameter of cam 21 being such that shoulder 20 of link 16 will strike some part of the end of cam 21 whenever link 16 moves upwardly.

Valve rod 19 is axially biased upwardly by water pressure and if desired may be further biased upwardly toward sphere 13 by means of a spring (now shown). Whenever handle 14 is released the upward bias on valve rod 19 moves link 16 upwardly, rotating handle 14 and sphere 13 in seat 12 until shoulder 20 strikes cam 21. In the position shown in FIG. 1A the valve will then be off.

Pivot 18 is mounted on a swivel 22 which comprises the upper end of valve rod 19, permitting handle 14 and link 16 to be rotated to any degree about the axis of valve stem 19. Nut 49 below swivel 22 is adjusted up and down on rod 19 to assure proper closing action. When handle 14 is depressed and rotated shoulder 20 strikes cam or stop 21 at a different elevation, permitting the flow from spout 10 to be maintained at any level. Furthermore, the flow from spout 10 may be temporarily increased by depressing handle 14 without rotating it and upon release of handle 14 the flow will return to the former level. By aligning handle 14 with spout 10 and releasing the handle the valve is closed and the flow terminates.

The upper portion of valve rod 19 extending from swivel 22 through a packing into spout 10 is provided with a passage 23 to admit air into the top of spout 10. For that purpose said upper section of valve rod 19 may desirably be a rigid tube 24. A check valve prevents upward flow through tube 24.

Water is supplied to spout 10 through pipe 25 which extends downwardly to a valve below frost level, and thence to a source of water. Sections of pipe 25 may be joined as needed with conventional couplings 26 and extensions of valve rod 19 through pipe 25 may be joined by conventional couplings such as the half-lapped coupling joined with a screw shown at 27.

Pipe 25 is surrounded by an outer housing pipe 28 which extends from spout 10 to skirt 29, skirt 29 being bolted to a flange 30 near ground level on reservoir pipe 35. The connections between spout 10, outer housing pipe 28, and skirt 29, are such as to shed water away from pipe 25.

Outer housing pipe 28 may desirably be provided with a window 31. A warning sleeve 32 has a colored portion (shown stippled) to serve as an indicator which may be viewed through window 31 only when sleeve 32 is raised. Sleeve 32 is supported on float rod 33 which extends downwardly through skirt 29 into a reservoir 34 having a side wall comprising a pipe 35 sealed by a gasket 36 at the top to skirt 29, sealing pressure being applied by the bolts which hold skirt 29 to flange 30.

Figure 1B:
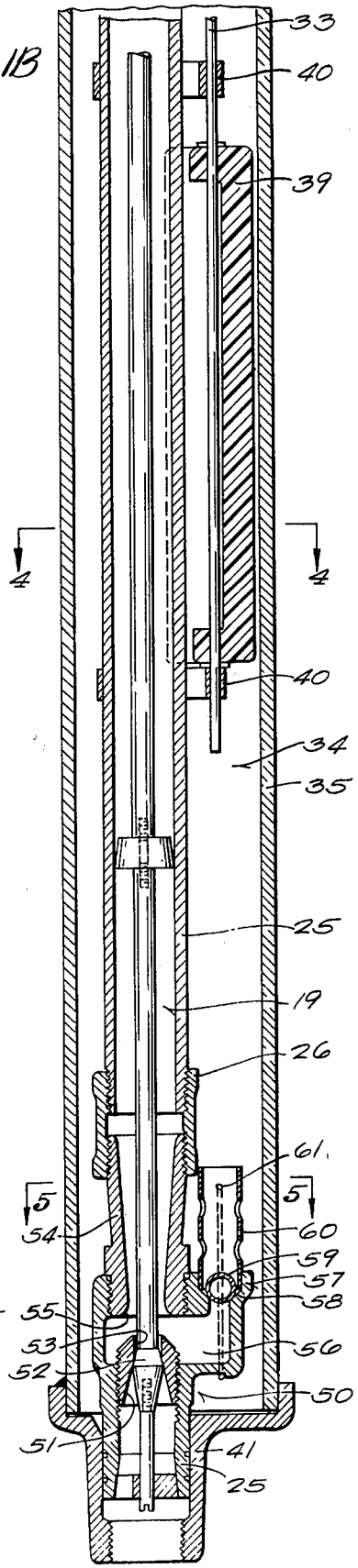
FIG. 1B is a downward continuation of the view of FIG. 1A.

Reservoir 34 is provided with a vent 37 through skirt 29 into the space enclosed by outer housing pipe 28. Vent 37 may be sealed by a valve 38 fixed to float rod 33. As best shown in FIG. 1B float rod 33 is fixed to a float 39 and is desirably provided with guides 40. When the water rises too high in reservoir 34 it encounters float 39 and lifts it, raising rod 33. Rod 33 carries valve 38 into engagement with vent 37, sealing it, and at the same time raises warning sleeve 32 to a position in which the indicator portion is visible through window 31. Since that portion of sleeve 32 is highly visible, desirably red, this conveys a warning that reservoir 34 is too full.

Reservoir 34 is closed at the bottom by means of a fitting 41 sealed to pipe 35 and to a source of water here shown as pipe 25.

A valve and venturi fitting 50 receives water from pipe 25 where it enters fitting 41. The valve and venturi are a single structure including a valve seat 51 comprising a converging conical passage. A double conical valve closure 52 mates with seat 51 and is secured to valve operating rod 19. A valve orifice 53 surrounds rod 19 and is sufficiently larger than the rod to permit full flow when rod 19 is depressed enough to fully open the valve by movement of valve closure 52 downwardly within valve seat 51.

Axially aligned with orifice 53 is a diverging cone 54 which desirably begins with a short section of converging passage radius 55 to assure that the cylindrical jet of water emerging from orifice 53 around rod 19 will be efficiently transferred to diverging cone 54 of the venturi. The jet of water emerging from orifice 53 is surrounded by cavity 56 which opens to reservoir 34 though check valve 57. Check valve 57 consists of a seat 58, a buoyant ball 59, and a perforated passage 60 extending from valve seat 58 to the interior of reservoir 34. The buoyant ball 59 is kept within perforated passage 60 by the small diameter of seat 58 at one end and by a clip 61 having a leg extending through perforated passage 60 to retain the ball 59 within the passage and a second leg extending around fitting 50 to maintain the clip in assembled relationship.

Desirably main valve seat 51 is threaded into fitting 50, as is the diverging venturi cone 54.

The operation of the structure just described is such that when valve closure member 52 is moved downwardly by valve operating rod 19, a circular orifice 53 is opened permitting water to travel at high speed across cavity 56 and into diverging cone 54. The low pressure present in cavity 56, which is the high speed portion of the venturi, draws water from reservoir 34, along with supply water, up pipe 25 to spout 10 as long as buoyant ball 59 is supported by the water within reservoir 34 against clip 61. When sufficient water has been withdrawn from reservoir 34 so that the buoyant ball approaches check valve seat 58, the flow of water and the low pressure in cavity 56 seals ball 59 to seat 58 closing the check valve and terminating flow from reservoir 34 up pipe 25. At that time, little water remains in reservoir 34. When the main valve is closed by moving valve closure 52 upwardly to seat against complementary valve seat 51 (either by water pressure or by a biasing spring) there is no longer a flow of water across cavity 56 to lower the pressure. However, there is a column of water extending from fitting 50 to spout 10. Since valve closure 52 is maintained in closed position by water pressure or by spring bias or both, the column of water displaces ball 59 upwardly in perforated tube 60 toward clip 61. This permits the water in pipe 25 to escape into reservoir 34 through the perforations in tube 60. Pipe 35 forming reservoir 34 is of adequate diameter, and extends to a sufficient depth when properly placed, to permit all water in pipe 25 to flow downwardly to a level below the frost level, preferably with a reserve capacity to accommodate additional water if reservoir 34 is not sufficiently drained in a particular cycle of operation.

As noted previously, reservoir 34 is vented at 37, and the vent is closed by float 39 and valve 38 if the water level in reservoir 34 becomes high enough to present a danger of frost damage, at the same time giving a visible signal by lifting sleeve 32 to a position in which the indicator is visible through window 31. The operator then merely depresses operating lever 14 sufficiently to fully open valve closure 52 and lets the water run for a short period while reservoir 34 drains.

It will be seen that I have provided a novel, convenient, and highly sanitary system for draining the upper portion of a yard hydrant to a level below the frost line, while keeping the water in the hydrant entirely separated from the ground water, and preventing backsiphoning, and have provided a number of novel mechanisms for carrying this invention into effect.

I claim:

1. A valve comprising communicating inlet and outlet passages, a valve closure means movable between a position permitting flow between said passages and a position obstructing flow between said passages, a valve operating rod connected to said closure means, a link pivotably and rotatably secured to the operating rod, a universally rotatably mounted sphere pivotably connected to said link at a point spaced from the center of said sphere, manual means for rotating said sphere, means biasing said operating rod toward said sphere, means restraining said sphere from movement of its center in the direction of the bias of said rod, a surface on said link positioned outside the surface of said sphere, a stop engagable with the surface when said link is moved by said bias, whereby to retain said valve closure in a desired position when said surface is engaged with said stop.

2. The device of claim 1 in which said stop is circular and concentric with said sphere, the surface of said stop being at an angle to the axis of said rod.

* * * * *